US005720524A

United States Patent [19]

Hall

[11] Patent Number: 5,720,524

[45] Date of Patent: Feb. 24, 1998

[54] COMBINATION ROTATABLE TOY AND STOOL

[76] Inventor: Albert J. Hall, 2985 SW. 136th Ave., Davie, Fla. 33330

[21] Appl. No.: 792,899

[22] Filed: Jan. 31, 1997

[51] Int. Cl.[6] ..... A47C 3/18; A47C 3/20

[52] U.S. Cl. ..... 297/338; 297/344.21; 297/344.26; 472/14; 108/94; 108/95; 248/188.4; 248/415

[58] Field of Search ..... 297/338, 344.21, 297/344.26; 472/14, 25; 248/157, 188.4, 415, 405; 108/94, 95, 150

[56] References Cited

U.S. PATENT DOCUMENTS

| | | | |
|---|---|---|---|
| 556,566 | 3/1896 | Stevens | 108/95 |
| 732,227 | 6/1903 | Shafer et al. | 108/95 |
| 2,010,306 | 8/1935 | Leech | 297/344.21 |
| 2,523,817 | 9/1950 | Conley et al. | 248/405 |
| 4,234,152 | 11/1980 | Browse | 472/14 |
| 4,334,482 | 6/1982 | Boldue | 108/94 |
| 4,570,547 | 2/1986 | Colby | 248/188.4 |

*Primary Examiner*—Peter M. Cuomo
*Assistant Examiner*—Anthony D. Barfield
*Attorney, Agent, or Firm*—Malin, Haley, DiMaggio & Crosby, PA

[57] ABSTRACT

A combination toy and stool is provided that rotates and simultaneously lowers when a child sits on the seat. When the seat lowers fully, the invention can be used as a stool. The invention includes a stool seat that has a helically grooved or twisted central shaft extending below the seat, and a plurality of support shafts spaced about the central shaft also extending below the seat. The seat sets onto a pedestal that incorporates an upper and a lower member that rotate relative to each other similar to a "lazy susan". The upper pedestal member has a plurality of upward extending tubular members that receive the support shafts that extend below the seat. The lower pedestal member has an upward extending central shaft that extends through the center of the upper pedestal member and receives the twisted central shaft of the seat in a vertical aperture in the central shaft. The vertical aperture of the upward extending central shaft includes a plurality of positioned ball bearings that engage the twisted shaft of the seat, and cause the seat to rotate as it lowers into the central shaft of the lower pedestal member. The rotating seat causes the upper pedestal member to rotate by contact between the downward extending shafts of the seat and the upward extending tubular members of the upper pedestal member. A child sitting on the seat can thus place his/her feet on the upper pedestal member, which will rotate in unison with the seat. When the seat reaches the end of its lowering movement, the invention can be used as a stool. When the child stands up, the seat can be automatically raised to the starting position, by one or more springs in one or more of the upward extending tubular members, to repeat the rotation and lowering action.

8 Claims, 3 Drawing Sheets

COMBINATION ROTATABLE TOY AND STOOL

BACKGROUND OF THE INVENTION

1. Field of the Invention

This invention relates generally to toys and stools, and in particular to a combination rotatable child's toy and stool.

2. Description of Related Art

Applicant is not aware of any combination rotatable toy and stool, similar to the present invention, existing in the known art. There are in the art different types of children's chairs and stools, as well as a large variety of toys. However, to the best of applicant's knowledge, a combination stool and toy that rotates and lowers a child when the child sits on the stool does not exist. There is always a need to entertain and amuse children.

SUMMARY OF THE INVENTION

The present invention is a combination toy and stool that rotates and simultaneously lowers when a child sits on the seat. When the seat lowers fully, the invention can be used as a stool.

The invention consists generally of three main items, the first of which includes an essentially horizontal planar stool seat, that can be disk shaped, that has a helically grooved or twisted central shaft extending below the seat, and a plurality of support shafts spaced about the central shaft also extending below the seat.

The seat sets onto a pedestal that incorporates an upper and a lower member that are the other two main items of the invention. The two pedestal members act together in rotation relative to each other similar to what is known as a "lazy susan".

The bottom member of the pedestal has a central shaft, of relatively large diameter, that extends upward from an essentially planar base that can be essentially disk shaped.

The upper member of the pedestal also has an essentially planar base, that can be essentially disk shaped, and that has a central aperture, or open area, sized to receive the upward extending central shaft of the lower pedestal member. The upper and lower members are thus positioned adjacent each other.

Separating the upper and lower members of the pedestal is a means to provide rotation of the upper member relative to the lower member about a central axis. One example of a means to provide rotation is a series of ball bearings and a pair of retainer plates made together as a unit with an internal race to hold the ball bearings, such that the plates rotate relative to each other. One retainer plate is attached to each planar base, or other suitable means, to permit the upper and lower members to rotate relative to each other about a central axis. This device to provide rotation, in itself, is known in the art and is commonly used to provide rotation for a "lazy susan" structure.

The upper pedestal member includes a plurality of upward extending tubular support members positioned, and sized, to receive the plurality of support shafts extending downward below the seat. The seat will rotate along with the upper pedestal member in relation to the lower pedestal member.

The upward extending central shaft of the lower pedestal member has a central vertical bore, or aperture, sufficiently large to receive the central helically grooved or twisted shaft extending downward below the seat. The upward extending shaft also includes a plurality of transverse holes extending from the exterior of the central shaft to the central bore. The transverse holes are sized to movably receive ball bearings, or a similar ball structure, one ball bearing each, of a size that fairly closely fits the helical grooves or twists in the central shaft of the seat.

The holes in the central shaft of the lower pedestal member can be angled downward toward the central bore of the shaft such that gravity will cause the ball bearings received in the holes to roll toward the central bore. Alternately, the ball bearings can be mechanically biased toward the central bore. A slightly smaller section of the transverse holes, adjacent the central bore, prevents the ball bearings from falling into the central bore.

When the seat is placed onto the pedestal, the downward extending support shafts are positioned into the upward extending support tubular members of the upper pedestal member. The central helically grooved or twisted shaft extending below the seat is positioned into the central bore of the upward extending central shaft of the lower pedestal member. The seat will slip downward until the central grooved or twisted shaft rests against the ball bearings located in the transverse holes in the central shaft of the lower pedestal member.

Upon placing additional pressure onto the seat, such as when a child sits on the stool seat, the ball bearings engage the helical grooves or twists in the central shaft of the stool causing the stool and the upper pedestal member to rotate in relation to the lower pedestal member as the stool simultaneously lowers. Because the upper pedestal member rotates along with the seat, a child can put his/her feet onto the base of the upper pedestal member while rotating.

The rotation and lowering motion continue until the helical grooved shaft of the seat bottoms out in the central bore of the central shaft of the lower pedestal member. A spring, or other cushioning means, can be provided at the lower end of the central bore of the central shaft of the lower pedestal member to reduce shock and cushion the bottoming of the seat.

Alternately, and preferably, one or more of the plurality of support shafts can be lengthened to bottom out in one or more of the upward extending support tubular members of the upper pedestal member prior to the central shaft bottoming out. The spring or other cushioning device mentioned above can be placed in one or more of the upward extending support tubular members, instead of the central bore of the central shaft of the lower pedestal member to absorb shock.

Once the seat bottoms out and cannot lower any farther, the invention can be used as a stool.

When the child stands up, the seat is automatically raised to the staring point by the one or more springs positioned in one or more of the upward extending tubular members, and the lowering and rotating action can repeat.

Accordingly, it is an object of the present invention to provide a toy stool that will rotate and simultaneously lower when a child sits upon the seat.

It is another object of the present invention to provide a toy stool that rotates and simultaneously lowers when a child sits on the seat and includes a rotating foot rest for the child.

It is a further object of the present invention to provide a toy stool that can be used as a standard stool.

In accordance with these and other objects which will become apparent hereinafter, the instant invention will now be described with particular reference to the accompanying drawings.

DESCRIPTION OF THE PREFERRED EMBODIMENTS

Figures 1, 2:
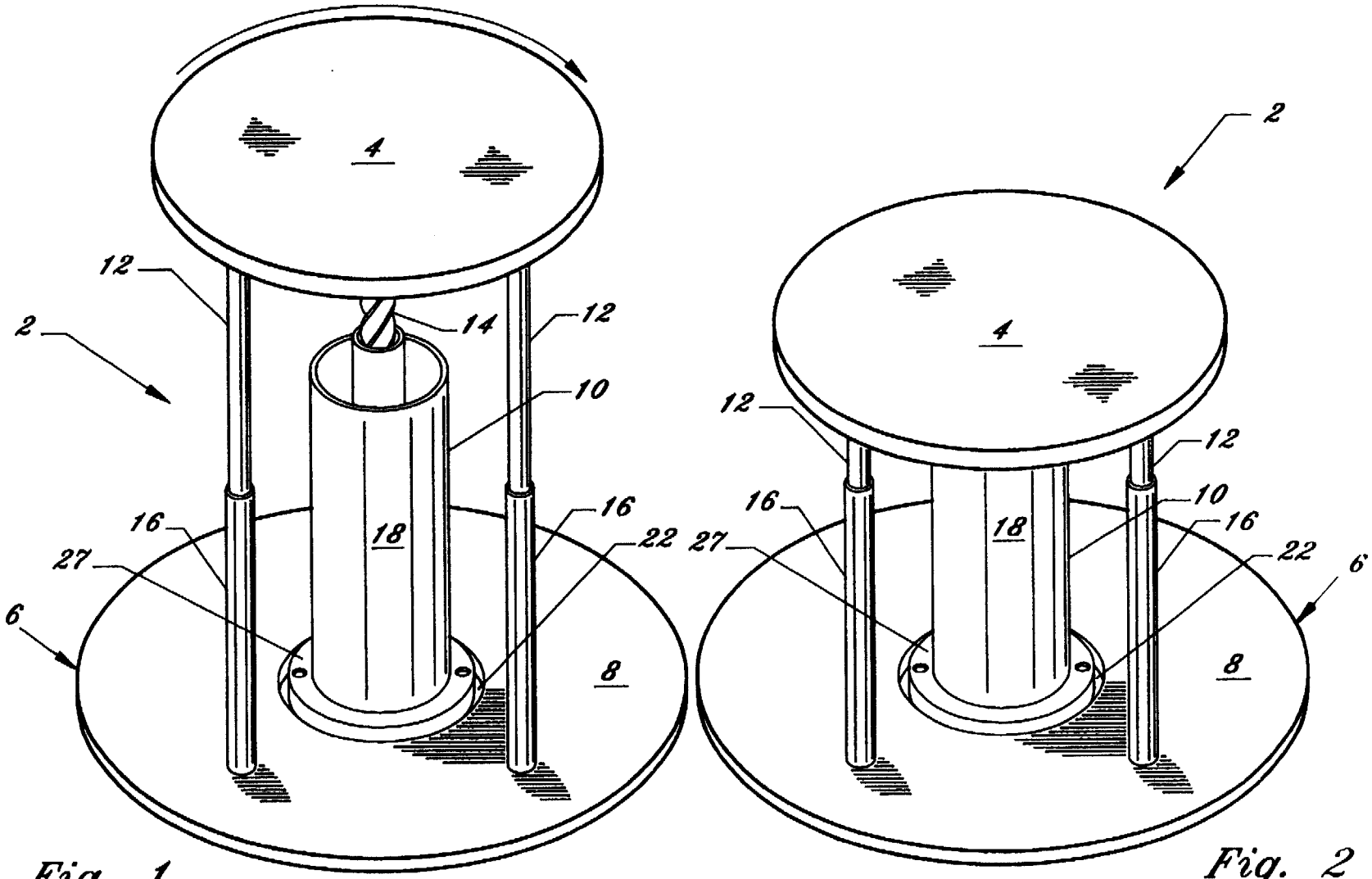
FIG. 1 is a perspective view of the present invention with the sea/at in an upper position.
FIG. 2 is a perspective view of the present invention with the seat at the lowest position.
Figure 3:
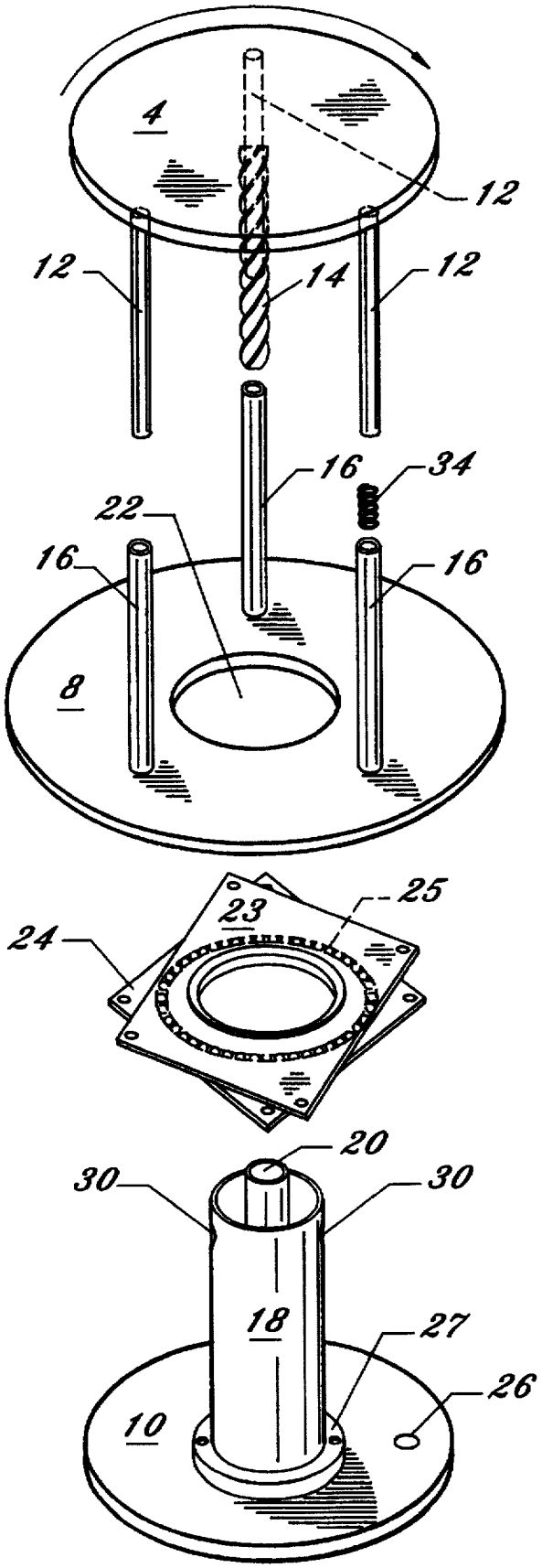
FIG. 3 is an exploded perspective view of the present invention.

Referring now to the figures, and in particular FIGS. 1, 2 and 3, one embodiment of the present invention, shown generally as 2, includes seat 4 and rotating pedestal 6 which includes upper rotating pedestal member 8 and lower fixed pedestal member 10. Seat 4, upper and lower pedestal members 8 and 10, respectively, are shown as generally disk shaped for example only. Shapes other than disk shaped are contemplated and included in the scope of the invention, the disk shape being the preferred embodiment.

Operation of the invention as a toy and a stool, which will be described in detail below, is generally described by referring to FIGS. 1 and 2 in sequence. Referring first to FIG. 1, when weight is placed onto seat 4, such as when a child sits on the seat, seat 4 and upper pedestal member 8 will rotate relative to lower pedestal member 10 which rests on the floor or ground and remains stationary. As seat 4 and upper pedestal member 8 rotate, seat 4 simultaneously lowers toward pedestal 6. When seat 4 reaches pedestal 6, or "bottoms out", as seen in FIG. 2, the lowering of seat 4, stops. When seat 4 is in the "bottomed out" position, as shown in FIG. 2, the invention 2 can be used as a standard stool. When the child stands up, seat 4 can be automatically raised to the starting position for another round of "spin the child".

Referring again to FIGS. 1–3, seat 4 includes a plurality of downward extending support shafts 12, and a helically grooved or twisted downward extending central shaft 14. Shaft 14 can be made of a narrow elongated piece of flat bar stock which is twisted to form a screw-like helically grooved shaft that is attached to the center of seat 4. Central shaft 14 can be made of any suitable material such as metal.

Upper pedestal member 8 includes a plurality of upward extending tubular support members 16, positioned and sized to receive the plurality of support shafts 12 that extend downward below seat 4. The support shafts 12 and the support tubular members 16, as described herein below, transmit rotation from the seat to the upper pedestal member, and can range from a single shaft and tubular member to nearly any number. Three support shafts 12 and three tubular support members 16 are used herein as example only, and form the preferred embodiment.

Bottom pedestal member 10 includes an upward extending central shaft 18, of relatively large diameter. Upward extending central shaft 18 includes central vertical bore, or aperture 20, which must be sufficiently large to receive the central helically grooved or twisted shaft 14 extending downward below seat 4.

Upper pedestal member 8 includes a central aperture or open area 22 sized to receive central shaft 18 of lower pedestal member 10. As shown in FIG. 3, upper pedestal member 8 fits onto lower pedestal member 10. Separating pedestal members 8 and 10 is a suitable means for rotation, such as plates 23 and 24, which are formed together an a unit with each plate having a mating circular race filled with a plurality of ball bearings 25, to permit rotation of upper plate 23 in relation to lower plate 24. Plate 24 is initially attached to lower pedestal member 10 by any suitable fasteners, such as screws (not shown). Plate 23 is then attached to the underside of upper pedestal member 8 by suitable fasteners (such as screws. Aperture 26 provides access to plate 23 for attachment to upper pedestal member 8. Thus, upper pedestal member 8 rotates in relation to lower pedestal member 10 in the same manner as a "lazy susan", as known in the art.

Central shaft 18 attaches to lower pedestal member 10 in any suitable manner, such as attachment collar 27.

Figure 5:
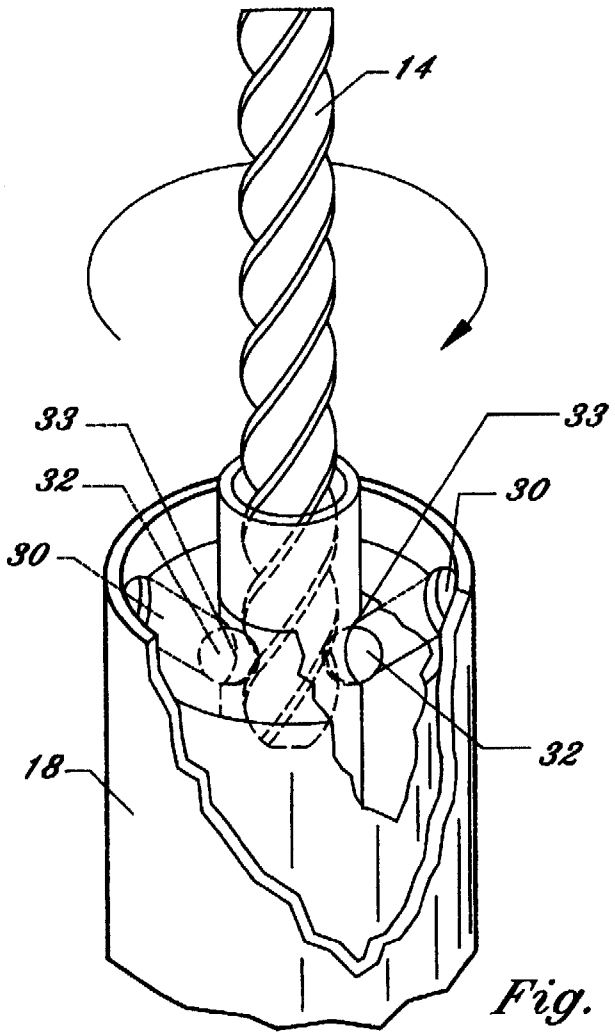
FIG. 5 is an enlarged partial cut away perspective view of the central shafts of the present invention.
Figure 4:
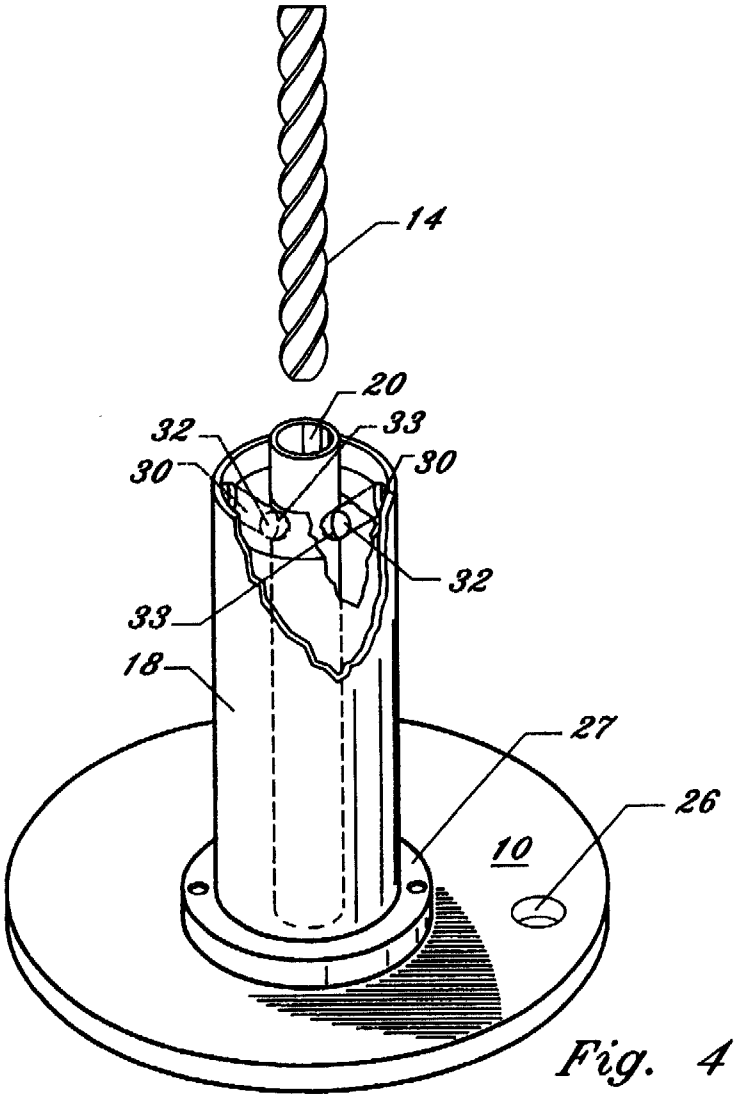
FIG. 4 is partial cut away perspective view of the central shafts of the present invention.

Referring now to FIGS. 4 and 5, central shaft 18 includes a plurality of transverse bores or apertures 30 that extend from the exterior of shaft 18 to the central aperture 20. Apertures 30 are sized to movably receive ball bearings 32. Ball bearings 32 can be made of any suitable material such as metal or glass, and are sized to fairly precisely fit the helical grooves or twists in shaft 14. Apertures 30 can be angled downward toward central aperture 20, such that gravity causes ball bearings 32 to fall toward central aperture 20. A restricted region 33 in aperture 30, adjacent central aperture 20, prevents ball bearings 32 from entering central aperture 20. Alternately, ball bearings 32 can be mechanically biased toward central shaft 20 (not shown).

In the preferred embodiment, there are two apertures 30 and two ball bearings 32.

When central shaft 14 is set into central aperture 20, ball bearings 32 engage the helical grooves or twists and cause shaft 14 to rotate, in "screw like" manner, as shaft 14 moves downward in aperture 20. The downward rotation of shaft 14 into aperture 20 causes seat 4 to rotate and lower, and in turn causes support shafts 12 to rotate and slide into tubular members 16. The rotation of support shafts 12 in tubular members 16 causes upper pedestal member 8 to rotate.

The rotation of seat 4 and upper pedestal member 8, and the lowering of seat 4 continues until one or more of the support shafts 12 reaches the bottom of one or more of the support tubular members 16, or "bottoms out". Spring 34, shown in FIG. 3, or other means for cushioning, is placed in the lower portion of one or more of the support tubular members 16 to absorb shock when a corresponding support shaft 12 bottoms out.

Once seat 4 reaches the end of movement downward, the invention can be used as a stool. When the child stands up, seat 4 can be automatically raised to the starting position, shown in FIG. 1, by one or more springs 34, one of which is shown in FIG. 3, thus providing for another rotation sequence as described above.

Other embodiments of the present invention, not limited to those mentioned herein above, are contemplated herein and considered within the scope of the invention. For example, the central helically grooved shaft 14 of the seat 4, and the central shaft 18 of the lower pedestal member 10 could be switched. The helically grooved shaft 14 would than extend upward from the lower pedestal member 10, and the central shaft 18 having the vertical aperture 20 and transverse apertures 30 with ball bearings 32 would extend downward from the center of the seat 4. Likewise, the support shafts 12 and support tubular members 16 could be switched so the support shafts 12 extend upward and the tubular members extend downward, or the shafts 14 can be made longer to bottom out in aperture 20 before one of the support shafts 12 bottoms out in a tubular member 16.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A combination rotatable toy and stool comprising:

a generally horizontal seat movable from a first position to a second position;

a rotating upper pedestal having means for connection to a bottom of said seat, said means for connection including means for slidable connection to said seat when said seat moves from said first position to said second position;

a fixed lower pedestal;

means for rotation of said rotating upper pedestal in relation to said fixed lower pedestal connected between said upper and said lower pedestals;

means for rotating said seat and said rotating upper pedestal in relation to said fixed lower pedestal when said seat moves from said first position to said second position, said means for rotating connected to said fixed lower pedestal.

2. The combination rotatable toy and stool of claim 1 wherein said means for rotating said seat and said rotating upper pedestal in relation to said fixed lower pedestal includes:

a first central shaft extending below said seat, said first central shaft having a helical groove;

a second central shaft extending upward and connected to said fixed lower pedestal, said second central shaft having a central vertical aperture sized to receive said first central shaft;

said second central shaft including at least one transverse aperture extending from an exterior surface of said second central shaft to said vertical aperture;

at least one ball bearing sized to fit said helical groove, said at least one ball bearing received in said at least one transverse aperture adjacent said vertical aperture, a portion of said at least one ball bearing extending into said vertical aperture to engage said helical groove.

3. The combination rotatable toy and stool of claim 2 wherein said at least one transverse aperture including means for biasing said at least one ball bearing toward said vertical aperture.

4. The combination rotatable toy and stool of claim 1 wherein said means for slidable connection includes:

at least one support shaft connected to said seat and extending downward;

at least one tubular member connected to said rotating upper pedestal and extending upward, said tubular member sized and positioned to receive said at least one support shaft, wherein said support shaft slides into said tubular member when said seat moves from said first position to said second position.

5. The combination rotatable toy and stool of claim 1 further including means for biasing said seat into said first position.

6. A combination rotatable toy and stool comprising:

a generally horizontal seat having an upper surface, a lower surface, and a first central axis, said seat movable between a first and a second position;

a helically grooved shaft connected to said lower surface at said first central axis and extending downward from said seat;

at least one support shaft connected to said lower surface, spaced apart from said first central axis, and extending downward from said seat;

a rotating upper pedestal having a first generally horizontal planar base member with a second central axis and at least one upward extending tubular member sized and positioned to receive said at least one support shaft, said first base member having an aperture coaxial with said second central axis;

a fixed lower pedestal having a second generally horizontal planar base member with a third central axis and a relatively large diameter upward extending shaft coaxial with said third central axis, said shaft having an essentially vertical elongated central aperture sized to receive said helically grooved shaft;

said first base member having an aperture coaxial with said second central axis and sized to receive said relatively large diameter upward extending shaft;

said rotating upper pedestal received adjacent said fixed lower pedestal with said second and third central axis being coaxial;

means for rotation of said rotating upper pedestal in relation to said fixed lower pedestal, said means for rotation positioned between said first base member and said second base member;

said relatively large diameter upward extending shaft including a plurality of transverse apertures extending from an exterior surface of said relatively large diameter upward extending shaft to said essentially vertical elongated central aperture;

a plurality of ball bearings, one each received within each of said transverse apertures, means for biasing said ball bearings toward said essentially vertical elongated central aperture, and means to prevent said ball bearings from falling into said essentially vertical elongated central aperture, said ball bearings sized to closely fit against said helically grooved shaft;

said helically grooved shaft received in said essentially vertical elongated central aperture, and said at least one support shaft received in said at least one upward extending tubular member, said first central axis being coaxial with said second and said third central axis;

wherein when a preselected amount of weight is placed onto said upper surface of said seat, said seat, said helically grooved shaft, and said at least one support shaft lower toward said upper and said lower pedestals, and simultaneously said ball bearings engage said helically grooved shaft rotating said helically grooved shaft and thereby rotating said seat, said at least one support shaft, said at least one upward extending tubular member, said first base member, and said rotating upper pedestal, while said seat moves from said first position to said second position.

7. The combination rotatable toy and stool of claim 6 wherein said means for biasing said ball bearings toward said essentially vertical elongated central aperture is gravity due to each of said transverse apertures angling in a downward direction from said exterior surface to said essentially vertical elongated central aperture; and, said means to prevent said ball bearings from falling into said essentially vertical elongated central aperture is a restricted diameter in each of said transverse apertures adjacent said essentially vertical elongated central aperture.

8. The combination rotatable toy and stool of claim 6 further including at least one spring located within said at least one upward extending tubular member for biasing said seat into said first position.

* * * * *